US012611708B2

(12) United States Patent
Henry et al.

(10) Patent No.: US 12,611,708 B2
(45) Date of Patent: Apr. 28, 2026

(54) HAND-HELD IMPACT TOOL FOR CREATING DENT FLAWS

(71) Applicant: Textron Innovations Inc., Providence, RI (US)

(72) Inventors: Tyson Henry, Arlington, TX (US); Simon Tetreault, Sainte-Therese (CA); Jerome Sebastien Borie, Saint-Jerome (CA)

(73) Assignee: Textron Innovations Inc., Providence, RI (US)

( * ) Notice: Subject to any disclaimer, the term of this patent is extended or adjusted under 35 U.S.C. 154(b) by 321 days.

(21) Appl. No.: 18/598,365

(22) Filed: Mar. 7, 2024

(65) Prior Publication Data

US 2025/0281965 A1 Sep. 11, 2025

(51) Int. Cl.
*B21J 7/24* (2006.01)
*B21J 7/46* (2006.01)

(52) U.S. Cl.
CPC .. *B21J 7/24* (2013.01); *B21J 7/46* (2013.01)

(58) Field of Classification Search
CPC ..... B21J 7/24; B25D 17/08
USPC ..... 173/90
See application file for complete search history.

(56) References Cited

U.S. PATENT DOCUMENTS 9,079,286 B1 * 7/2015 DeCamillis ..... B25D 17/08
10,926,577 B1 * 2/2021 DeCamillis ..... B44B 11/02

* cited by examiner

*Primary Examiner* — Nathaniel C Chukwurah
(74) *Attorney, Agent, or Firm* — Bradley Arant Boult Cummings LLP

(57) ABSTRACT

An impact tool includes a cylindrical body having an internal chamber, a piston assembly positioned within the internal chamber, the piston assembly having a piston base and a piston rod, an adapter arranged on the cylindrical body and having external threads, and a location tip assembly having an opening and having internal threads couplable to the adapter by engaging the external threads relative to the internal threads to create a threaded connection, the threaded connection allows the location tip assembly to be moved axially to a selectable height. An impact tip coupled to an end of the piston rod. Upon introduction of pressurized air within the internal chamber, the piston assembly moves axially towards the adapter causing the impact tip to move axially through the opening towards a surface resulting in impact with the surface to be dented.

20 Claims, 5 Drawing Sheets

HAND-HELD IMPACT TOOL FOR CREATING DENT FLAWS

BACKGROUND OF THE INVENTION

Technical Field

The present invention relates generally to hand-held tools and, more particularly, but not by way of limitation, to impact type hand-held tools for creating repeatable and controlled dent flaws on parts.

History of Related Art

Other representations used for creating dent flaws on parts were labor intensive and created challenges to support parts due to large forces involved in statically pressing dents. Other challenges included complex geometry of parts with locations that were hard to reach to create dent flaws or that the parts were cumbersome to mount to a fixture to be able to reach these locations. Additionally, other representations used for creating dent flaws on parts proved more difficult to manage force and/or depth of the dent flaw and posed challenges in maintaining locational accuracy.

BRIEF SUMMARY OF THE INVENTION

An impact tool includes a cylindrical body having an internal chamber formed therein, a piston assembly positioned within the internal chamber, the piston assembly comprising a piston base and a piston rod, and an adapter arranged on the cylindrical body and having external threads formed therein. The impact tool further includes a location tip assembly comprising an opening and having internal threads formed therein, wherein the location tip assembly is couplable to the adapter by engaging the external threads of the adapter relative to the internal threads of the location tip assembly to create a threaded connection, wherein the threaded connection allows the location tip assembly to be moved axially to a selectable height relative to the adapter. The impact tool further includes an impact tip coupled to an end of the piston rod and at least one air valve configured to regulate an amount of pressurized air within the internal chamber. Upon introduction of the pressurized air within the internal chamber, the piston assembly moves axially towards the adapter, thereby causing the impact tip to move axially through the opening towards a surface, thereby resulting in impact with the surface to be dented.

An impact tool includes a cylindrical body having an internal chamber formed therein, a piston assembly positioned within the internal chamber, the piston assembly having a piston base and a piston rod, and an adapter arranged on the cylindrical body and having external threads formed therein. The impact tool further includes a location tip assembly having an opening and internal threads formed therein, wherein the location tip assembly is couplable to the adapter via a threaded connection between the external threads of the adapter with the internal threads of the location tip assembly, wherein the threaded connection allows the location tip assembly to be moved axially to a selectable height relative to the adapter. The impact tool further includes an impact tip coupled to an end of the piston rod and at least one air valve configured to introduce an amount of pressurized air within the internal chamber causing the impact tip to move axially through the opening towards a surface, thereby resulting in impact with the surface to be dented. A depth of impact is controlled by adjusting at least one of the amount of pressurized air introduced into the internal chamber and the height of the location tip assembly.

An impact tool includes a cylindrical body having an internal chamber formed therein, a piston assembly positioned within the internal chamber, the piston assembly having a piston base and a piston rod, an adapter arranged on the cylindrical body and having external threads formed therein, and an interchangeable location tip assembly having a concave shaped opening and internal threads formed therein, wherein the interchangeable location tip assembly is couplable to the adapter by engaging the external threads of the adapter relative to the internal threads of the interchangeable location tip assembly to create a threaded connection, wherein the threaded connection allows the interchangeable location tip assembly to be moved axially to a selectable height relative to the adapter. The impact tool further includes an impact tip coupled to an end of the piston rod via an intermediate connector and at least one air valve configured to introduce an amount of pressurized air within the internal chamber causing the impact tip to move axially through the opening towards a surface, thereby resulting in impact with the surface to be dented. A depth of impact is controlled by adjusting at least one of the amount of pressurized air introduced into the internal chamber and the height of the location tip assembly.

DETAILED DESCRIPTION OF THE INVENTION

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present disclosure, the devices, members, apparatuses, and the like described herein may be positioned in any desired orientation. Thus, the use of terms such as "above." "below," "upper," "lower" or other like terms to describe a spatial relationship between various components or to describe the spatial orientation of aspects of such components should be understood to describe a relative relationship between the components or a spatial orientation of aspects of such components, respectively, as the device described herein may be oriented in any desired direction. In addition, as used herein, the term "coupled" may include direct or indirect coupling by any means, including moving and/or non-moving mechanical connections.

Figure 1:
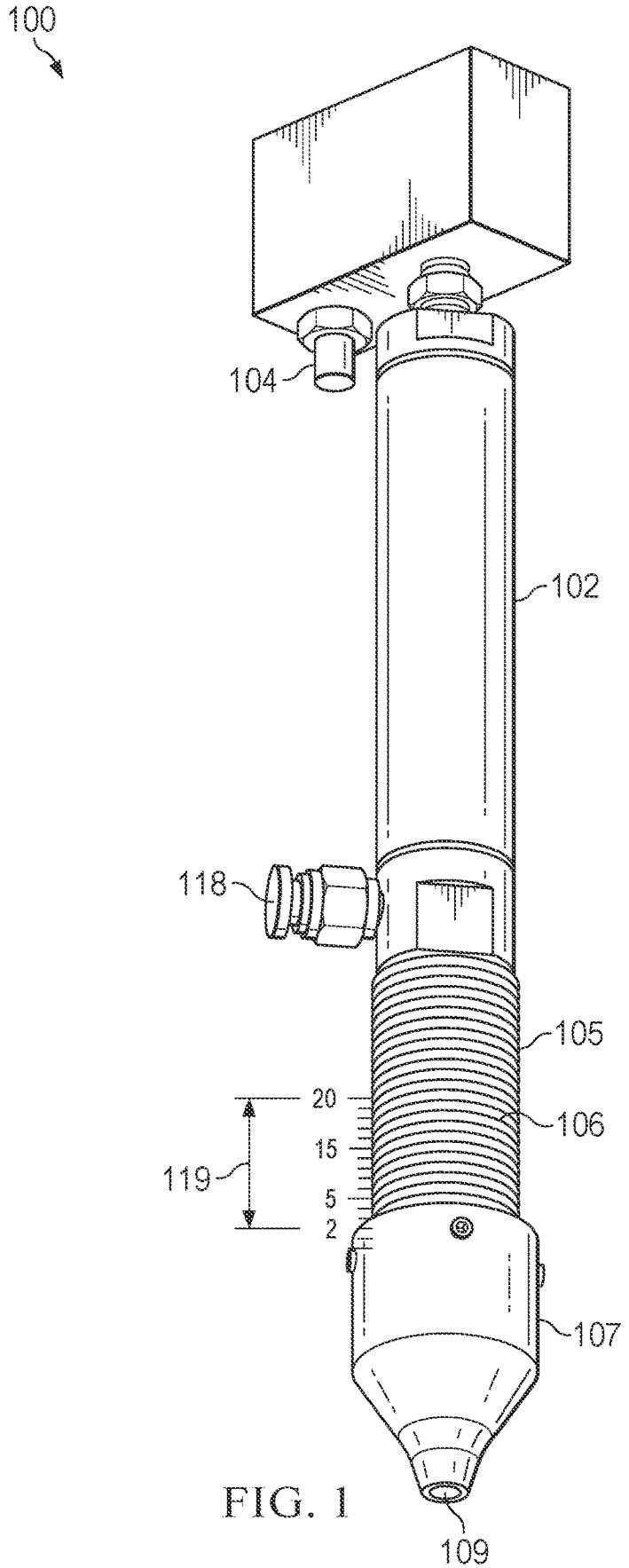
FIG. 1 is a side perspective view of an exemplary impact tool.
Figure 2:
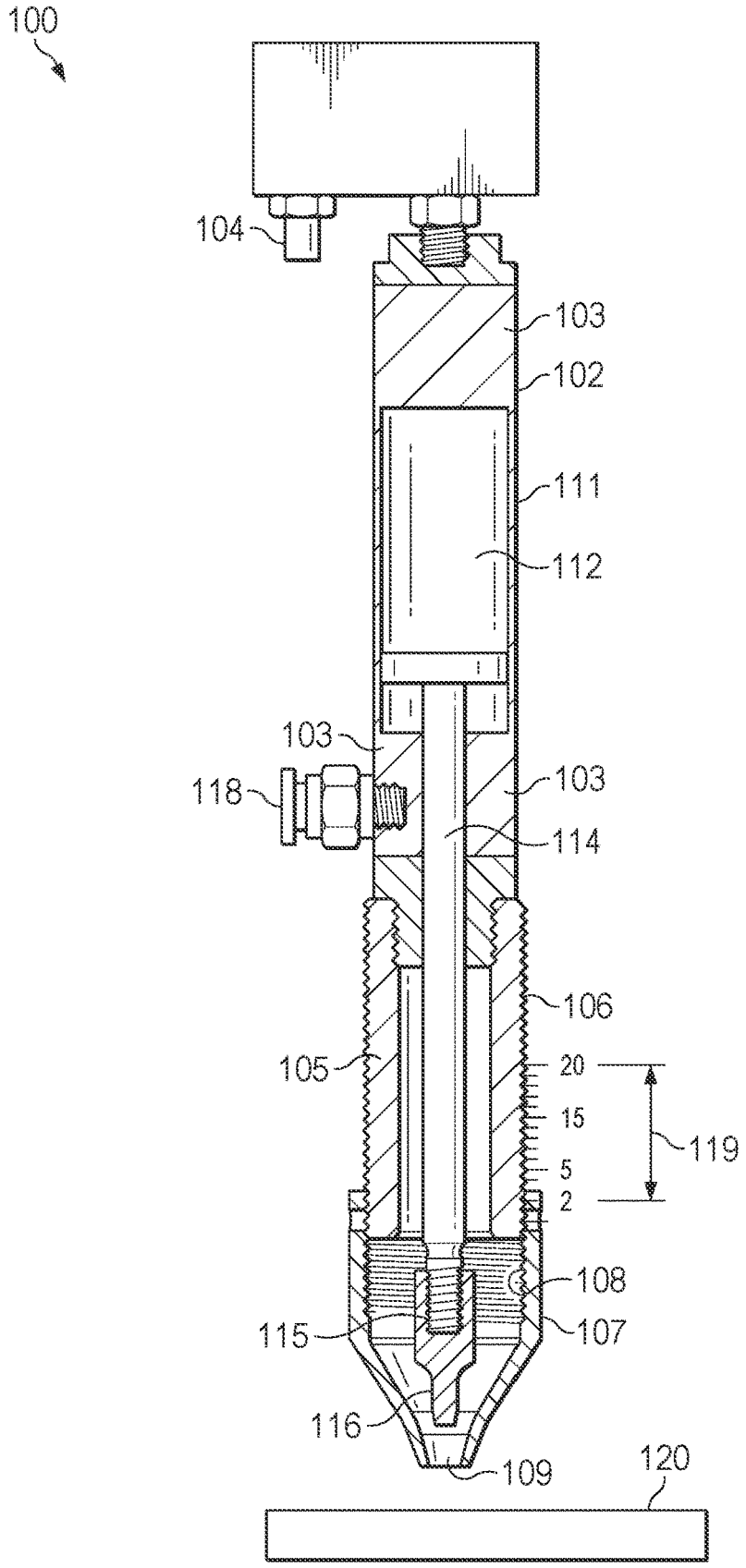
FIG. 2 is a partially sectioned side elevational view of the exemplary impact tool of FIG. 1.

FIG. 1 is a side perspective view of an exemplary impact tool 100. FIG. 2 is a partially sectioned side elevational view of the impact tool 100 of FIG. 1. Referring now to FIGS. 1-2, in a typical embodiment, the impact tool 100 may be, for example, a handheld tool that is lightweight and compact. The impact tool 100 includes a cylindrical body 102 having an internal chamber 103 formed therein. An air supply valve 104 is located at or near a rear end of the internal chamber 103 and an air release valve 118 is located towards a central region of the internal chamber 103. In a typical embodiment, the air supply valve 104 is connected to or is in communication with an air source that supplies pressurized air to the impact tool 100. The air supply valve 104 regulates an amount of pressurized air introduced in the internal chamber 103. For illustrative purposes, the impact tool 100 is described as using compressed air via multiple air valves such as, for example, the air supply valve 104 and the air release valve 118; however, in other embodiments, the impact tool 100 can be operated using a single air valve. The impact tool 100 further includes an adapter 105 arranged on the cylindrical body 102. In a typical embodiment, the adapter 105 includes external threads 106 formed therein.

The impact tool 100 further includes a location tip assembly 107 having internal threads 108 formed therein. The internal threads 108 correspond to the external threads 106 of the adapter 105. The adapter 105 is coupled to the location tip assembly 107 by engaging the external threads 106 of the adapter 105 into the corresponding internal threads 108 of the location tip assembly 107. In a typical embodiment, the threaded connection between the adapter 105 and the location tip assembly 107 allows the location tip assembly 107 to be moved axially to a selectable height relative to the adapter 105. Due to the threaded connection between the adapter 105 and the location tip assembly 107, the location tip assembly 107 can be completely removed from the impact tool 100 and replaced with another location tip assembly 107 of any suitable shape and size. As such, according to exemplary embodiments, the location tip assembly 107 is interchangeable. The adapter 105 further includes depth markings 119 that allow the impact tool 100 to create controlled dent flaws on parts. In the embodiment illustrated in FIGS. 1-2, the location tip assembly 107 is cylindrical in shape and includes a substantially circular opening 109; however, in other embodiments, the location tip assembly 107 and the opening 109 can be any shape that, for example, mates with a specific surface to be dented.

The impact tool 100 includes a piston assembly 111 configured to move axially within the internal chamber 103 of the cylindrical body 102 in response to pulses of pressurized air from the air supply valve 104. The piston assembly 111 includes a piston base 112 located towards a rear end of the internal chamber 103 and a piston rod 114 extending forward from the piston base 112. In a typical embodiment, the piston base 112 has a shape and a diameter approximating a cross-section of the internal chamber 103. The piston rod 114 has a diameter that is smaller than the diameter of the piston base 112. In a typical embodiment, the piston rod 114 may be an integral extension of the piston base 112. In other embodiments, the piston rod 114 may be a separate piece that is connected to the piston base 112.

The impact tool 100 further includes an impact tip 116 secured to an end 115 of the piston rod 114. In a typical embodiment, the impact tip 116 is directly secured to the end 115 of the piston rod 114 via, for example, a threaded connection: however, in other embodiments, the impact tip 116 may be secured to the end 115 of the piston rod 114 via other connection mechanisms such as, for example, a set screw or the like. In other embodiments, the impact tip 116 is not directly secured to the end 115 of the piston rod 114 and includes an intermediate connector between the impact tip 116 and the end 115 of the piston rod 114. In a typical embodiment, components of the impact tool 100 are made of metals such as, for example, aluminum, steel, brass and the like to withstand pneumatic pressures involved in the impact tool's 100 operation, repeated striking of impact surfaces, and other factors recognized by those skilled in the art. In other embodiments, some of the parts of the impact tool 100 may be made from other materials such as, for example, polymers or composite resin-type materials. For illustrative purposes, the impact tool 100 is described as using compressed air: however, in other embodiments, a coil-type compression spring or hydraulics may be used to operate the impact tool 100.

Operation of the impact tool 100 will now be described in detail. When compressed air is introduced to the air supply valve 104 and the piston assembly 111, compressed air fills the internal chamber 103 of the cylindrical body 102. The air pressure in the internal chamber 103 attempts to push the piston assembly 111 further towards the rear of the impact tool 100 by pressing against the piston rod 114, but the air pressure in a lower region of the internal chamber 103 attempts to push the piston assembly 111 in the opposite direction by pressing against the piston base 112. Since a surface area of the piston base 112 is greater than a surface area of the piston rod 114, the piston rod 114 moves axially downwards towards the adapter 105. As a result, the impact tip 116, which is secured to the end 115 of the piston rod 114 also moves axially downwards towards the opening 109 of the location tip assembly 107, resulting in an impact between the impact tip 116 and a surface 120 to be dented. In a typical embodiment, the surface 120 may be, for example, a section of a part, a metal sheet, or any other section of a surface having a complex geometry.

The impact tool 100 offers the ability to manage the force and depth of impact to create precise dent flaws on parts. Since the impact tool 100 utilizes variable air pressure, a force of impact between the impact tip 116 and the surface 120 to create dent flaws may be precisely controlled. For example, an increase in the air pressure will cause the impact tip 116 to move axially downward with increased force, resulting in impact between the impact tip 116 and the surface 120 with increased force and depth to create dent flaws. Additionally, by adjusting a height of the location tip assembly 107 relative to the adapter 105 via the threaded connection between the adapter 105 and the location tip assembly 107, a depth of impact between the impact tip 116 and the surface 120 to create dent flaws may be precisely controlled. For example, each unit (e.g., 2, 5, 15, 20 thousandth of an inch or "thou") on the depth markings 119 corresponds to a specific selected depth of impact between the impact tip 116 and the surface 120. For example, if a dent flaw in the range of approximately 2-5 thou is desired, the height of the location tip assembly 107 relative to the adapter 105 may be set between 2-5 thou on the depth markings 119. If a dent flaw in the range of approximately 10-20 thou is desired, the height of the location tip assembly 107 relative to the adapter 105 may be set between 10-20 thou on the depth markings 119. As such, the impact tool 100 may be configured to create dent flaws on the surface 120 in a controlled manner by adjusting at least one of, for example, the air pressure and the height of the location tip assembly 107.

Figure 3:
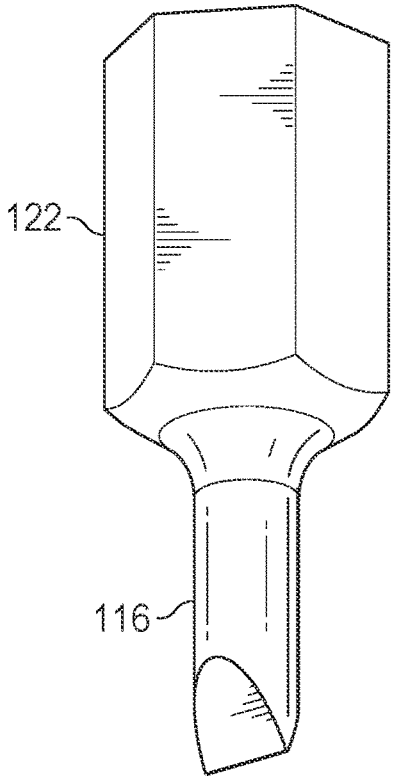
FIG. 3 is a side perspective view of an impact tip for use with the exemplary impact tool.

FIG. 3 is a side perspective view of the impact tip 116 for use with the impact tool 100. For illustrative purposes, FIG. 3 will be described herein relative to FIGS. 1-2. In a typical embodiment, the impact tip 116 includes a tip base 122 that is an integral extension to the impact tip 116. The tip base 122 includes a hollow cylindrical body having internal threads (not illustrated). In a typical embodiment, the impact tip 116 is directly secured to the end 115 of the piston rod 114 via, for example, a threaded connection between the tip base 122 and the end 115 of the piston rod 114. In a typical embodiment, the impact tip 116 may be, for example, a machined metal piece or three-dimensionally printed to a specific shape as dictated by design requirements. In a typical embodiment, the impact tip 116 is made of metals such as, for example, aluminum, steel, brass or the like to withstand pneumatic pressures involved in the impact tool's 100 operation, repeated striking of impact surfaces, and other factors recognized by those skilled in the art.

Figure 4:
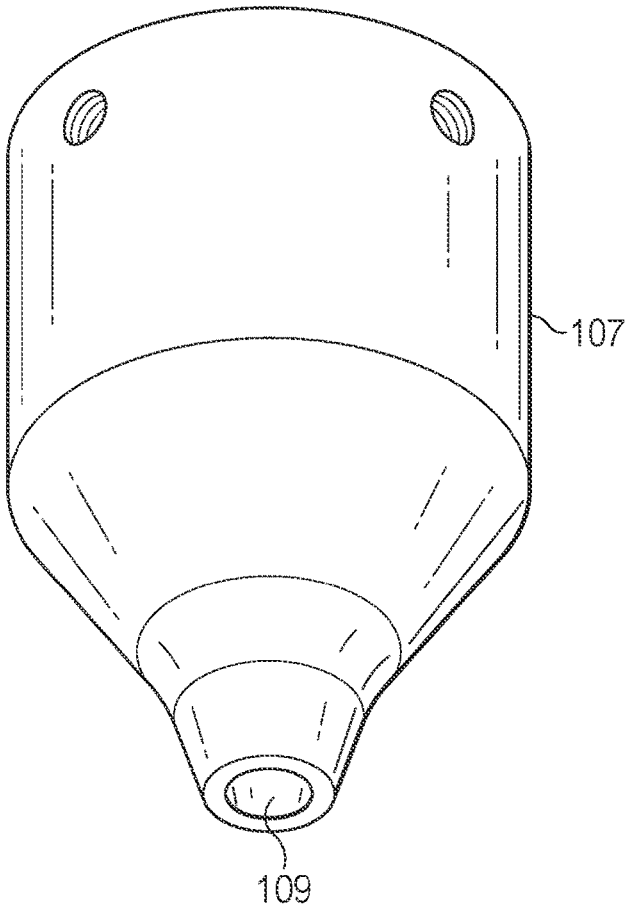
FIG. 4 is a side perspective view of a location tip assembly for use with the exemplary impact tool.

FIG. 4 is a side perspective view of the location tip assembly 107 for use with the impact tool 100. For illustrative purposes, FIG. 4 will be described herein relative to FIGS. 1-2. In a typical embodiment, the location tip assembly 107 is substantially cylindrical in shape and includes a substantially circular opening 109; however, in other embodiments, the location tip assembly 107 and the opening 109 can be three dimensionally printed to any suitable shape that mates with a specific surface to be dented. In a typical embodiment, the location tip assembly 107 is made of metals such as, for example, aluminum, steel, brass and the like to withstand pneumatic pressures involved in the impact tool's 100 operation, repeated striking of impact surfaces, and other factors recognized by those skilled in the art.

Figure 5:
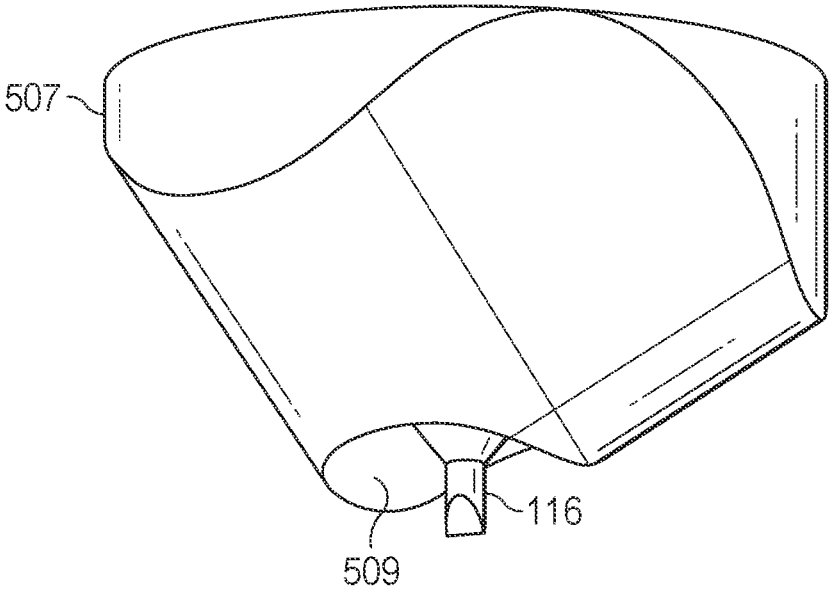
FIG. 5 is a side perspective view of an alternate location tip assembly for use with the exemplary impact tool.

FIG. 5 is a side perspective view of an alternate location tip assembly 507 for use with the impact tool 100. For illustrative purposes, FIG. 5 will be described herein relative to FIGS. 1-2. In a typical embodiment, the location tip assembly 507 is substantially dodecahedron in shape and includes a substantially concave opening 509 that allows the location tip assembly 507 and the opening 509 to mate with a surface with complex geometry to be dented. In a typical embodiment, the location tip assembly 507 is made of metals such as, for example, aluminum, steel, brass, and the like to withstand pneumatic pressures involved in the impact tool's 100 operation, repeated striking of impact surfaces, and other factors recognized by those skilled in the art.

Figure 6:
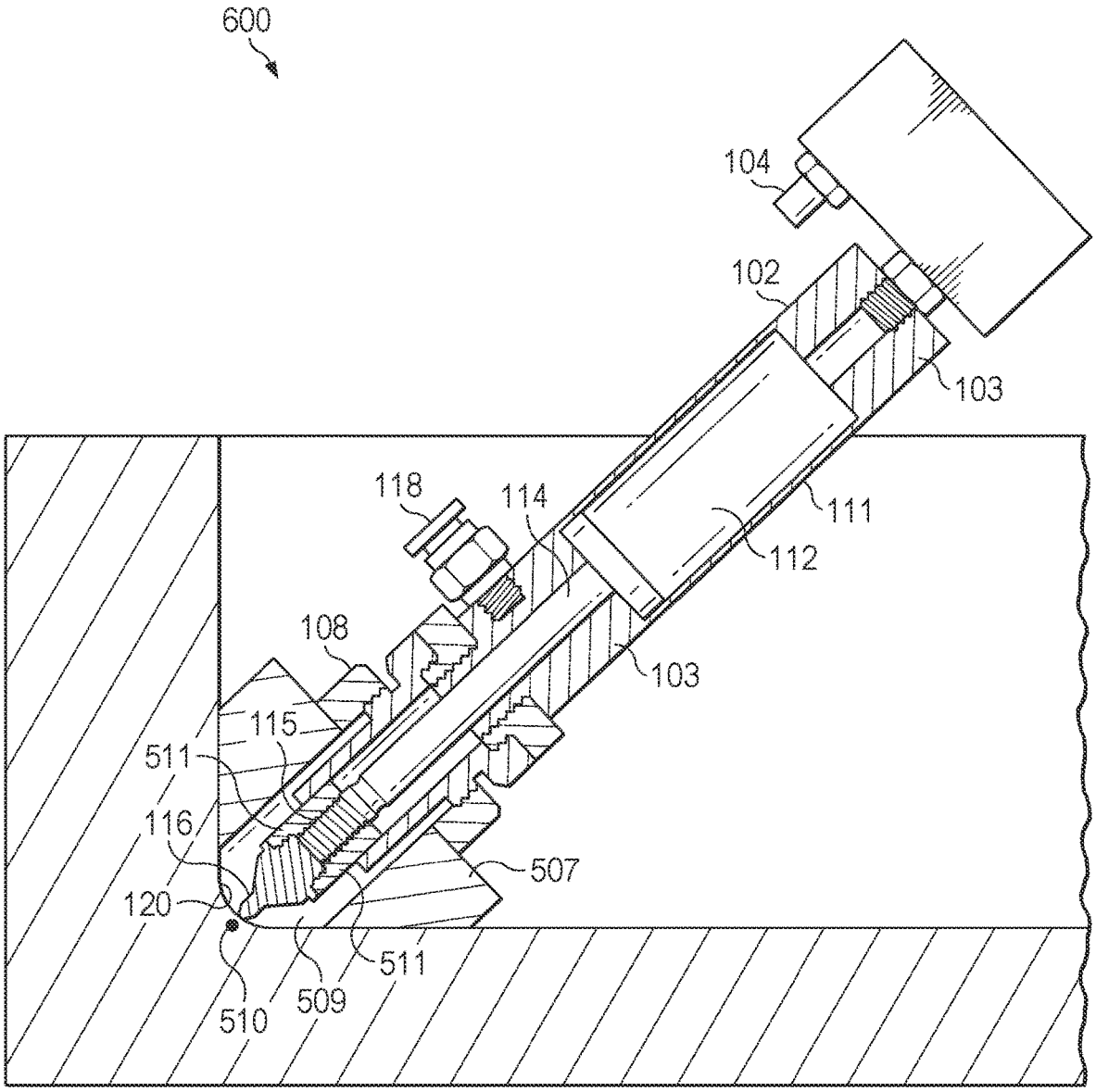
FIG. 6 is a partially sectioned side elevational view of the exemplary impact tool incorporating the alternate location tip assembly of FIG. 5.

FIG. 6 is a partially sectioned side elevational view of the impact tool 600 incorporating the alternate location tip assembly of FIG. 5. The impact tool 600 is similar to the impact tool 100 illustrated in FIGS. 1-2 in all but two aspects. Firstly, the impact tool 600 incorporates the location tip assembly 507 described with respect to FIG. 5. In a typical embodiment, the location tip assembly 507 is substantially dodecahedron in shape and includes the substantially concave shaped opening 509 allowing the location tip assembly 507 and the opening 509 to create dent flaws on a specific region 510 of the surface 120 which would be impossible to reach with the cylindrical shaped location tip assembly 107 described in FIG. 4. Secondly, the impact tip 116 is not directly secured to the end 115 of the piston rod 114 and includes an intermediate connector 511 between the impact tip 116 and the end 115 of the piston rod 114. The intermediate connector 511 provides the ability to independently adjust a depth and rotation of the impact tip 116. In a typical embodiment, the intermediate connector 511 is internally threaded and is substantially hexagonal in shape allowing anti-rotation of the piston rod 114. In a typical embodiment, the location tip assembly 107, 507 is interchangeable and can be three dimensionally printed to any suitable shape that is, for example, an inverse of the surface 120 to be dented.

Conditional language used herein, such as, among others, "can," "might." "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

Although various embodiments of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

The invention claimed is:

1. An impact tool comprising:

a cylindrical body having an internal chamber formed therein:

a piston assembly positioned within the internal chamber, the piston assembly comprising a piston base and a piston rod:

an adapter arranged on the cylindrical body and having external threads formed therein:

a location tip assembly comprising an opening and having internal threads formed therein, wherein the location tip assembly is couplable to the adapter by engaging the external threads of the adapter relative to the internal threads of the location tip assembly to create a threaded connection, wherein the threaded connection allows the location tip assembly to be moved axially to a selectable height relative to the adapter:

an impact tip coupled to an end of the piston rod; and at least one air valve configured to regulate an amount of pressurized air within the internal chamber;

wherein, upon introduction of the pressurized air within the internal chamber, the piston assembly moves axially towards the adapter, thereby causing the impact tip to move axially through the opening towards a surface, thereby resulting in impact with the surface to be dented.

2. The impact tool of claim 1, wherein increasing the amount of pressurized air within the internal chamber causes the piston assembly to move axially towards the adapter with increased force thereby causing the impact tip to move axially through the opening towards the surface with increased force, thereby resulting in the impact with more force and depth.

3. The impact tool of claim 1, wherein decreasing the amount of pressurized air within the internal chamber causes the piston assembly to move axially towards the adapter with decreased force causing the impact tip to move axially through the opening towards the surface with decreased force, thereby resulting in the impact with less force and depth.

4. The impact tool of claim 1, wherein a depth of impact between the impact tip and the surface may be controlled by adjusting the height of the location tip assembly relative to the adapter via the threaded connection.

5. The impact tool of claim 1, wherein the adapter comprises depth markings that correspond to a desired depth of impact between the impact tip and the surface.

6. The impact tool of claim 5, wherein setting the height of the location tip assembly between 2-5 thou in the depth markings results in an impact depth in a range of approximately 2-5 thou.

7. The impact tool of claim 5, wherein setting the height of the location tip assembly between 10-20 thou in the depth markings results in an impact depth in a range of approximately 10-20 thou.

8. The impact tool of claim 1, wherein:

the location tip assembly is substantially cylindrical in shape; and the opening is substantially circular.

9. The impact tool of claim 1, wherein:

the location tip assembly is substantially dodecahedron in shape; and the opening is substantially concave.

10. The impact tool of claim 1, wherein the threaded connection between the adapter and the location tip assembly allows the location tip assembly to be removed from the impact tool and replaced with another location tip assembly.

11. The impact tool of claim 10, wherein the location tip assembly is interchangeable with another location tip assembly of any suitable shape and size.

12. The impact tool of claim 1, wherein a depth of impact is controlled by adjusting at least one of the amount of pressurized air introduced into the internal chamber and the height of the location tip assembly.

13. An impact tool comprising:

a cylindrical body having an internal chamber formed therein:

a piston assembly positioned within the internal chamber, the piston assembly comprising a piston base and a piston rod:

an adapter arranged on the cylindrical body and having external threads formed therein;

a location tip assembly comprising an opening and having internal threads formed therein, wherein the location tip assembly is couplable to the adapter via a threaded connection between the external threads of the adapter with the internal threads of the location tip assembly, wherein the threaded connection allows the location tip assembly to be moved axially to a selectable height relative to the adapter:

an impact tip coupled to an end of the piston rod; and at least one air valve configured to introduce an amount of pressurized air within the internal chamber causing the impact tip to move axially through the opening towards a surface, thereby resulting in impact with the surface to be dented:

wherein a depth of impact is controlled by adjusting at least one of the amount of pressurized air introduced into the internal chamber and the height of the location tip assembly.

14. The impact tool of claim 13, wherein increasing the amount of pressurized air within the internal chamber causes the piston assembly to move axially towards the adapter with increased force thereby causing the impact tip to move axially through the opening towards the surface with increased force, thereby resulting in the impact with more force and depth.

15. The impact tool of claim 13, wherein decreasing the amount of pressurized air within the internal chamber causes the piston assembly to move axially towards the adapter with decreased force causing the impact tip to move axially through the opening towards the surface with decreased force, thereby resulting in the impact with less force and depth.

16. The impact tool of claim 13, wherein the adapter comprises depth markings that correspond to a desired depth of impact between the impact tip and the surface.

17. The impact tool of claim 16, wherein setting the height of the location tip assembly between 2-5 thou in the depth markings results in an impact depth in a range of approximately 2-5 thou.

18. The impact tool of claim 16, wherein setting the height of the location tip assembly between 10-20 thou in the depth markings results in an impact depth in a range of approximately 10-20 thou.

19. The impact tool of claim 13, wherein the location tip assembly is interchangeable with another location tip assembly of any suitable shape and size.

20. An impact tool comprising:

a cylindrical body having an internal chamber formed therein:

a piston assembly positioned within the internal chamber, the piston assembly comprising a piston base and a piston rod:

an adapter arranged on the cylindrical body and having external threads formed therein:

an interchangeable location tip assembly comprising a concave shaped opening and having internal threads formed therein, wherein the interchangeable location tip assembly is couplable to the adapter by engaging the external threads of the adapter relative to the internal threads of the interchangeable location tip assembly to create a threaded connection, wherein the threaded connection allows the interchangeable location tip assembly to be moved axially to a selectable height relative to the adapter;

an impact tip coupled to an end of the piston rod via an intermediate connector; and at least one air valve configured to introduce an amount of pressurized air within the internal chamber causing the impact tip to move axially through the opening towards a surface, thereby resulting in impact with the surface to be dented;

wherein a depth of impact is controlled by adjusting at least one of the amount of pressurized air introduced into the internal chamber and the height of the location tip assembly.

* * * * *